US005641010A

United States Patent [19]

Maier

[11] Patent Number: 5,641,010

[45] Date of Patent: Jun. 24, 1997

[54] MIXING AND DISPENSING APPARATUS

[75] Inventor: Gunther L. Maier, Yorba Linda, Calif.

[73] Assignee: International Medication Systems, Limited, South El Monte, Calif.

[21] Appl. No.: 459,348

[22] Filed: Jun. 2, 1995

[30] Foreign Application Priority Data

Jul. 14, 1994 [EP] European Pat. Off. ..... 94305163

[51] Int. Cl.[6] ..... A61J 1/00

[52] U.S. Cl. ..... 141/329; 141/386; 141/319; 141/27; 604/412; 604/416

[58] Field of Search ..... 141/18, 21–27, 141/319, 320, 329, 330, 383, 385, 386; 604/411–416

[56] References Cited

U.S. PATENT DOCUMENTS

| | | | |
|---|---|---|---|
| 3,376,866 | 4/1968 | Ogle | 128/220 |
| 3,542,023 | 11/1970 | Ogle | 128/218 |
| 3,563,415 | 2/1971 | Ogle | 222/145 |
| 4,128,098 | 12/1978 | Bloom et al. | 604/414 X |
| 4,516,967 | 5/1985 | Kopfer | 604/87 |
| 4,576,211 | 3/1986 | Valentini et al. | 141/329 |
| 4,607,671 | 8/1986 | Aalto et al. | 141/329 |
| 4,675,020 | 6/1987 | McPhee | 604/411 |
| 4,737,144 | 4/1988 | Choksi | 604/247 |
| 4,787,429 | 11/1988 | Valentini et al. | 141/329 X |
| 4,869,384 | 9/1989 | Ogle, II | 215/247 |
| 5,088,996 | 2/1992 | Kopfer et al. | 604/415 |
| 5,137,524 | 8/1992 | Lynn et al. | 604/414 X |
| 5,211,638 | 5/1993 | Dudar et al. | 604/411 X |
| 5,454,409 | 10/1995 | McAffer et al. | 141/329 |
| 5,526,853 | 6/1996 | McPhee et al. | 141/329 |

FOREIGN PATENT DOCUMENTS

| | | | |
|---|---|---|---|
| 86/01712 | 3/1986 | WIPO | 604/412 |
| 9211897 | 7/1992 | WIPO . | |

*Primary Examiner*—J. Casimer Jacyna
*Attorney, Agent, or Firm*—Christie, Parker & Hale, LLP

[57] ABSTRACT

Apparatus for mixing liquid with material stored in a container having an opening sealed by a resilient plug includes an adapter having a bore extending through it. The bore is shaped at one end to receive the container plug facing toward the other end of the bore. A first fitting having a passageway extending through it is secured to the adapter at the said other end of the bore. An elongated cannula is sealed at one end to the first fitting passageway so the other end of the cannula penetrates the plug as the container is inserted into the adapter to provide a flow path from the material to the passageway in the first fitting, which is shaped to make a releasable fluidtight seal with a second fitting having a passageway extending through it and adapted to be connected to means for connecting the second fitting passageway to a source of liquid with means for causing the liquid to flow into the container and mix with the material stored in it. Flexible fingers on the adapter firmly clamp the cannula to the container.

4 Claims, 3 Drawing Sheets

MIXING AND DISPENSING APPARATUS

BACKGROUND OF THE INVENTION

This invention relates to apparatus for mixing and dispensing a liquid with another material, such as a solid or another liquid.

Various devices have been proposed for mixing a liquid with a solid or another liquid to form a fresh mixture just before use. Such devices are particularly useful in preparing aqueous solutions of medicaments which are not very stable in solution, and therefore should be administered shortly after mixing.

U.S. Pat. No. 3,542,023 to Ogle (1970 ) discloses a successful two-compartment device for mixing a medicament in a container compartment with a liquid in a syringe compartment just before administration. U.S. Pat. No. 4,516,967 to Kopfer (1985 ) discloses another two-compartment device for mixing a medicament powder with a liquid just prior to use.

One disadvantage of some of the prior art devices is that they use a cannula permanently secured at one end to a syringe compartment of the device so the cannula is used both for the mixing operation and subsequent administration of the mixture. Accordingly, the diameter of the cannula must be relatively small to permit its use on a patient or at an injection site. The restricted size of the cannula makes it difficult and time-consuming to achieve proper mixing of the liquid and the medicament. Another disadvantage of some of the prior art devices is that after the mixing is completed, the cannula is withdrawn from the container for the medicament, and the sharp end of the cannula is exposed. This creates a hazard to operating personnel, especially when handling drugs which are toxic, mutagenic, or otherwise dangerous if allowed to contact a human being in an uncontrolled or improper manner. The anti-tumor drugs are an example of a class of medicaments presenting this hazard.

Another disadvantage of the prior art devices is they are bulky, expensive to make, and do not provide for safe disposal of used medicament containers, or the cannulas used for mixing.

SUMMARY OF THE INVENTION

This invention provides mixing apparatus which makes it easy to mix rapidly a liquid in a syringe compartment with a material in the container through a relatively large-diameter mixing cannula, the sharp end of which is never exposed, even after the mixing operation. Moreover, once the mixing is completed, the syringe compartment with the mixture can be disconnected from the mixing cannula, which is left in the container which held the medicament before mixing. Thereafter, the syringe compartment can be connected to a cannula of any size, preferably a small one for comfortable and direct administration to a patient, or for penetration of an injection site of an intravenous container without objectionable damage to the injection site. Alternatively, after the syringe compartment is separated from the mixing cannula, the syringe compartment can be connected to a "needleless" injection site through a standard Luer-lock connection.

In the preferred embodiment of this invention the mixing cannula is formed integrally with an adapter which easily locks onto the neck of the container, and cannot thereafter be easily removed from the container. Many containers with different storage capacity use a standard neck and top, making the adapter of this invention one which is "universal" because it can be used with containers of different sizes.

In brief, the apparatus of this invention facilitates rapid and easy mixing of a material, such as a medicament, stored in a container having an opening or mouth sealed by a resilient plug.

The preferred form of this invention includes an adapter with an end wall having a bore extending through it from an inlet side of the wall to an outlet side of the wall. Elongated flexible fingers secured to the wall at spaced locations around the bore define a cavity on the inlet side of the wall and opening away from the inlet side of the wall to receive the lip and neck of a container as the container is inserted into the cavity with a plug in the mouth of the container facing toward the wall. The effective diameter of the cavity is less than the maximum diameter of an annular shoulder on the container at a location spaced from the lip, which has an undersurface facing toward the annular shoulder. A first fitting having a passageway extending through it is secured to the outlet side of the adapter wall so the first fitting is connected to the bore. An elongated mixing cannula with a passageway extending through it is secured at one end to the inlet side of the adapter wall so the mixing cannula passageway is connected to the bore. The cannula extends away from the wall so the other end of the cannula will penetrate the plug in the container opening as the container is inserted into the cavity to spread the fingers slightly so they slip over the container lip. Further insertion causes the fingers engage the annular shoulder on the container. This provides a flow path from the material in the container to the passageway in the first fitting, which is shaped to make a releasable fluidtight seal with a second fitting and connect the first fitting passageway with a passageway extending through the second fitting, which includes means for connecting the passageway of the second fitting to a source of a liquid with means for causing the liquid to flow into the container and mix with the material stored in it. Inwardly facing detent means on each finger make a snug fit against the underside of the lip and hold the fingers against the shoulder to make it difficult to remove the adapter from the container after the second fitting is separated from the first. Preferably, the mixing cannula, first fitting, fingers, and wall of the adapter are integrally molded from a durable plastic, such as ABS, or polycarbonate, which is not adversely affected by sterilizing radiation.

In a preferred form of the invention, one of the fittings has a tapered socket, and the other fitting has a tapered nozzle so that the two fittings can be releasably sealed together, as is done with a conventional Luer-lock connector. Preferably, the mixing cannula has an internal diameter of at least about 0.0375 inch.

These and other aspects of the invention will be more fully understood in the following detailed disclosure and the accompanying drawings.

DESCRIPTION OF THE PREFERRED EMBODIMENT

Figure 1:
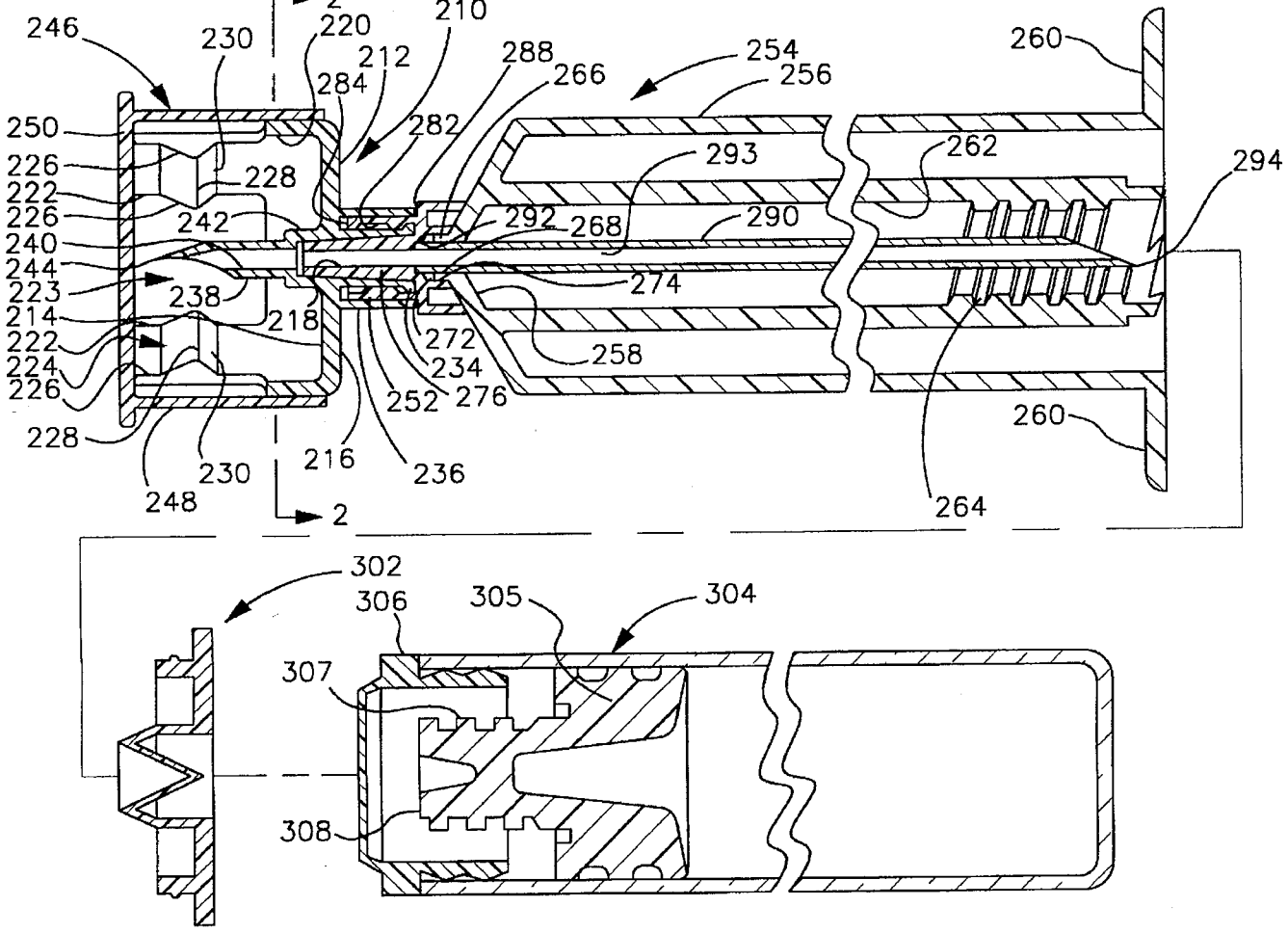
FIG. 1 is a longitudinal sectional exploded view of another preferred embodiment of the invention.
Figure 2:
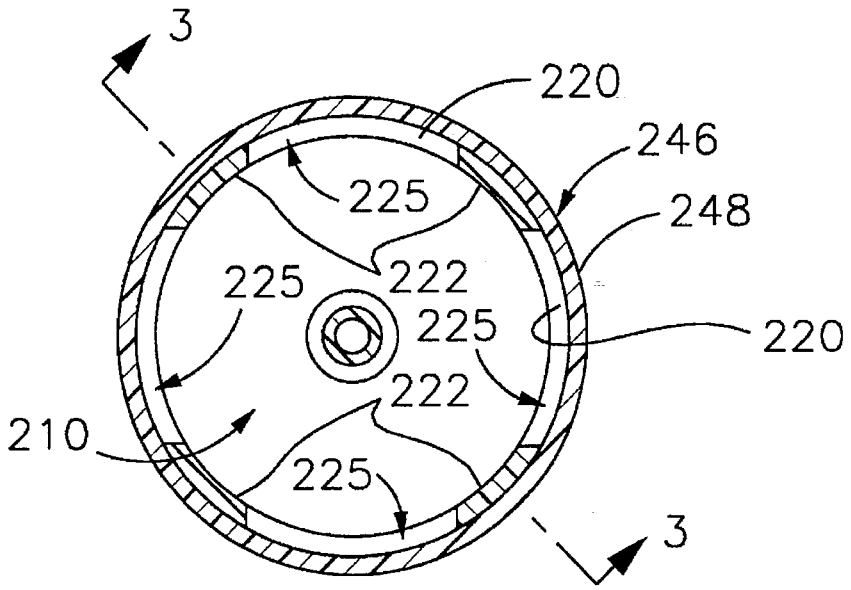
FIG. 2 is a view taken on line 2—2 of FIG. 1.

Referring to FIGS. 1-4, which show the preferred embodiment of the invention, an adapter 210 includes a circular end wall 212 which has an inlet side 214 and an outlet side 216 on its left and right faces, respectively, as viewed in FIG. 1.

A central bore 218 extends through the adapter end wall from the inlet side to the outlet side. An annular sidewall 220 is formed integrally with the periphery of the adapter end wall and extends to the left (as viewed in FIG. 1) to be coaxial with respect to the bore 218. Four elongated fingers 222 are symmetrically disposed around the central bore 218. Each finger is formed integrally at its right (as viewed in FIG. 1) end with the free edge of the annular sidewall 220, and extends parallel to the longitudinal axis of the central bore to define a cylindrical cavity 223, which opens to the left (as viewed in FIG. 1). A separate inwardly extending detent 224 is formed integrally on the inner face of each finger, which has an inwardly facing concave surface that subtends an angle of about 35° around the bore, leaving respective spaces 225 between adjacent edges of the fingers, as shown best in FIG. 2. Each detent is spaced a relatively short distance from the left (as viewed in FIG. 1) end of its respective finger, and includes a leading ramp surface 226 tapered to extend inwardly in the direction from left to right (as viewed in FIG. 1). The leading surface 226 terminates at a peak or ridge 228. A locking surface 230 tapers outwardly from the ridge in a direction from left to right (as viewed in FIG. 1) at an angle more nearly perpendicular to the longitudinal axis of the central bore than that of the leading surface 226.

Figure 3:
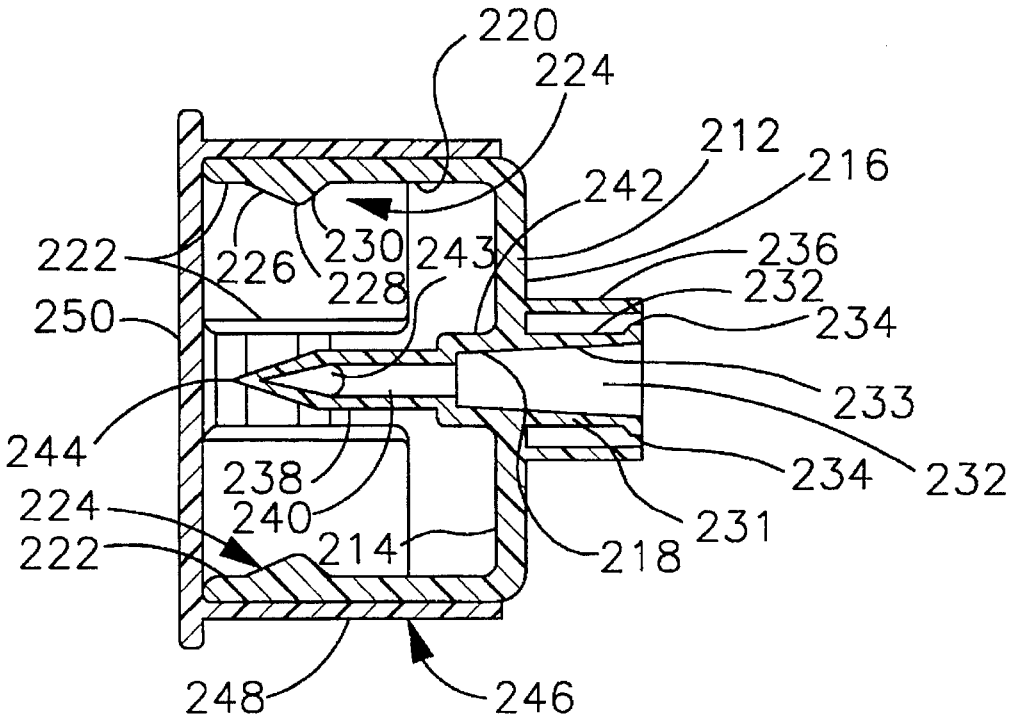
FIG. 3 is an enlarged fragmentary view taken on line 3—3 of FIG. 2, with the two fittings connected together and the container inserted in the adapter so the mixing cannula pierces the plug.

As shown best in FIG. 3, the inward slope rate of the locking surface 230 is at least twice that of the leading surface 226. For example, the acute angle between the leading surface 226 and the axis of the central bore is about 20°. The corresponding angle for the locking surface is about 65°. The purpose of this structure is explained below with respect to locking the adapter to the container.

A first fitting 231, in the shape of a Luer-Lock socket, is formed integrally with the outlet or right (as viewed in FIGS. 1 and 3) side of the end wall 212 around central bore 218. The first fitting has a central passageway 232, which is coaxial with central bore 218, and which tapers outwardly to the right at an angle of about three degrees to the longitudinal axis of central bore 218 to form a tapered socket 233. A pair of diametrically opposed and outwardly extending ears 234 are integrally formed with the right end of the first fitting, which can be of any suitable type, but preferably is that known as a"Luer-lock". The ears are shaped to serve as external threads. An annular shroud 236 is disposed coaxially around, and spaced from, the first fitting. The left end of the shroud is formed integrally with the outlet side of the end wall.

The shroud 236 is relatively short (as measured from the end wall 212 to the right end of the shroud) and has a relatively small outside diameter as compared to that of the annular sidewall 220. For example, the length of the fingers (as measured from their left ends to the end wall 212) is at least 50% greater than the length of the shroud, and the outside diameter of the annular sidewall 220 is at least 50% greater than that of the shroud.

An elongated spike or short first cannula 238 having a central passageway 240 collinear with the central bore 218 is formed integrally at its right (as viewed in FIGS. 1 and 3) and with an annular boss 242 formed integrally with the inlet side of the end wall 212 around bore 218. The left end of the cannula is cut off diagonally to provide an opening 243 from passage way 240 to the extension of the spike, and to form a sharp pointed scarf 244 to facilitate the cannula penetrating the plug in the container as described below. The scarf end of the cannula stops just short of the left ends of the fingers 222. A cylindrical cover 246 includes a cylindrical sidewall 248 which is open at its right end and disposed to make a snug fit around the exterior of the adapter as shown in FIG. 1. The left end of the cover is closed by an end wall 250 to keep the cannula sterile until ready for use.

Although the first fitting 231 and spike 238 are shown formed integrally with each other and with the adapter end wall 212, the first fitting and spike can be separate units, bonded together, and bonded (as by adhesive or spin-welding) to the end wall 212. Moreover, when the adapter is used with a medicament container closed by a pre-slitted plug or stopper, the scarf end of the spike can be relatively blunt.

Figure 4:
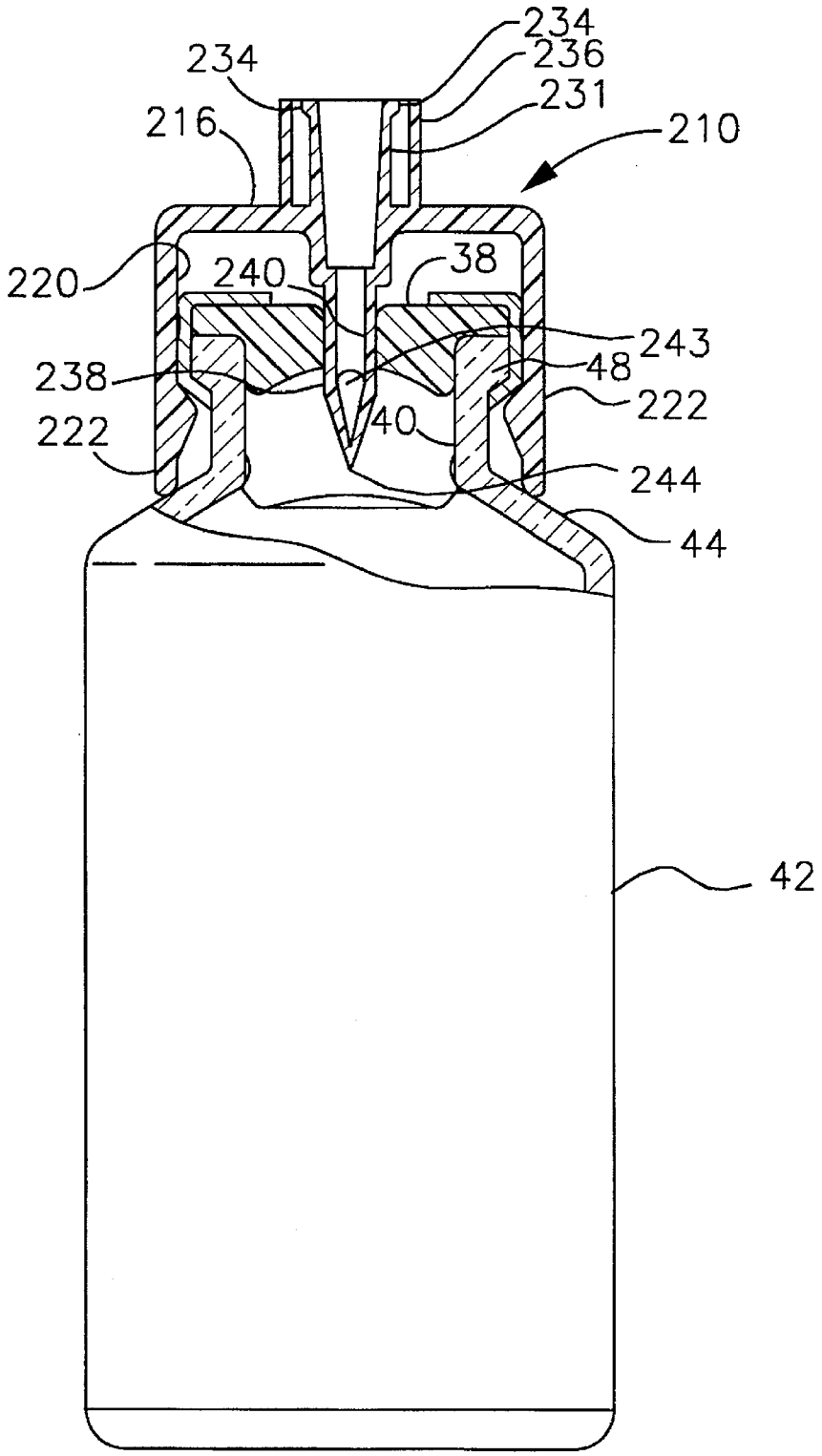
FIG. 4 is an elevational view, partly broken away, of the adapter affixed to the container after the mixing has taken place and the first fitting is separated from the second fitting.

As shown in FIG. 4, the short first cannula scarf is adapted to penetrate a resilient plug 38 which seals an opening 40 of a container 42, which holds a medicament, or other material (not shown), to be mixed with liquid (not shown). Preferably, the short cannula has a relatively large internal diameter, say, at least about 0.065 inch, and, therefore, is 14 gauge or larger.

Referring to FIG. 1, a second fitting 252 in the shape of a Luer-lock nozzle is bonded to the left (as viewed in FIG. 1) end of an injector 254. Injector 254 includes an elongated cylindrical outer sleeve 256 formed integrally at its inlet (left as viewed in FIG. 1) end with the outer periphery of an inlet end wall 258, which slopes inwardly and to the left (as viewed in FIGS. 1 and 3).

A pair of diametrically opposed and outwardly extending ears 260 are formed integrally with the outlet or right (as viewed in FIG. 1) end of the injector outer sleeve to lie in a plane perpendicular to the longitudinal axis of the adapter and the injector. A cylindrical inner sleeve 262 disposed coaxially within the outer sleeve is formed integrally at its inlet (left) end with the interior surface of annular inlet wall 258. The outlet (right) end of the inner sleeve is substantially co-extensive with the outlet end of the outer sleeve and has internal threads 264 as described below.

The inlet end of the injector includes an external annular boss 266 formed integrally with the annular end wall 258 around a central bore 268 extending through the end wall and boss. The Luer-lock nozzle fitting 252 includes an annular hub 272, which has a stepped bore 274 that makes a snug fit over the boss 266 of the injector. Preferably, the hub is sealed to the boss by any suitable means, such as with adhesive, or by spin-welding if the two elements are made of suitable plastics, such as polyethylene or polypropylene.

An externally tapered Luer-lock nozzle 276 is formed integrally with the hub 272 and makes a snug fit in the matching tapered socket 233 of the first Luer-lock socket fitting 231. The external ears 234 on the first Luer-lock socket fitting engage internal threads 282 in an annular skirt 284 formed integrally with the hub 272 and disposed coaxially around part of the Luer-lock nozzle. When the threads on the two fittings are screwed together, they releasably lock the two fittings together to form a fluidtight seal as shown in FIG. 1 so that the right end of shroud 236 almost touches an outwardly extending annular shoulder 288 formed on the exterior of hub 272. The skirt 284 makes a snug friction fit within the shroud. Thus, when the injector nozzle is inserted into the tapered socket and rotated to cause the Luer-lock threads to engage, the tapered nozzle is pulled snugly into a sealed, but releasable, engagement with the tapered socket, and the shroud, skirt and shoulder 288 provide support where the adapter is connected to the injector. This limits the strain placed on the joint of the two fittings during the mixing step described below.

A second or long cannula 290, disposed coaxially with the injector inner sleeve, is sealed at its inlet or left (as viewed in FIG. 1) end in a central bore 292 of stepped bore 274 extending through the hub and collinear with the central bore 268 in end wall 258 of the injector. The long cannula has a central passageway 293 extending through it to be collinear with bore 218 of end wall 212. The outlet (right) end of the second cannula includes a scarf 294, which is substantially coextensive with the outlet end of the inner sleeve. Preferably, the second cannula has a relatively large internal diameter, say, at least 0.065 inch, and therefore is 14 gauge or larger.

When the adapter and injector are assembled as shown in FIG. 1, the first and second cannulas and Luer-lock fittings form a continuous passageway through which a liquid (not shown) can pass to mix with material (not shown) in the medicament container 42, shown in FIG. 4 and as described below. The Luer-lock fittings may be of the type shown in U.S. Pat. No. 4,737,144 to Choksi (1988). If desired, the injector and adapter can be releasably locked together by conventional heat seals.

The outlet end of the injector is protected by a conventional removable injector cap 302 shaped to fit for a short distance within the inner sleeve and within the annular space between the inner and outer sleeves.

With the injector and adapter assembled as shown in FIG. 1, and with the adapter cover and injector cap in their respective positions, the assembled apparatus is packaged and sterilized in a container (not shown) until ready for use with the container 42 of medicament and with a diluent liquid, such as sterile water, in a cylindrical syringe barrel 304 sealed by a slidable stopper 305. A removable cap 306 is in the open end of the syringe barrel.

To use the apparatus shown in FIGS. 1 through 4, the container 42 of medicament is held in one hand, and the adapter with the inlet end uppermost is held in the other hand. The protective cap normally on the medicament container, and the protective adapter cover, are each removed. The stoppered end of the container is inserted into the cavity 223 of the adapter and pushed firmly home to cause the first or short mixing cannula or spike to penetrate the resilient plug in the stoppered end of the container. As the container is pushed to the home position (shown only in FIG. 4), the leading ramp of each detent rides on the lip of the container, and deflects the stiff, but slightly flexible, fingers outwardly until the ridge portions of the detent are passed and the fingers snap the detents back under the lip of the container as shown in FIG. 1. This action drives the left ends of the fingers snugly against the annular shoulder 44 of the container, and the locking surfaces 230 of the detents 224 firmly against the underside of the container lip 48, surrounding the opening 40 of the container. The short mixing cannula has now passed through the plug 38 in the container so that the interior of the container is connected by the short cannula to the inlet end of the long cannula. The plug 38 can be of any suitable type, such as the lyophilizing stopper shown in FIG. 4.

The apparatus is then inverted so that the vial injector is in the uppermost position and held with one hand. The calibrated syringe barrel 304 with the liquid is held in the other hand. The respective protective caps are flipped off the injector and the syringe barrel. The stoppered end of the syringe barrel is then inserted into the annular space between the inner and outer sleeves at the outlet end of the injector until external threads 307 on a reduced diameter portion 308 of the stopper 305 in the syringe barrel first engage the internal threads 264 in the inner sleeve of the injector. This contact is made gently, and then, without pushing, the syringe barrel is rotated about three turns to engage the threads and until a slight resistance is felt. An additional half turn of the syringe barrel causes the scarf end of the long cannula to pass completely through the syringe barrel stopper so that the liquid within the barrel is now in communication through the two cannulas with the material in the container 42. If that material is a medicament, the system assembled as just described is inverted, with the container 42 in the uppermost position. The syringe barrel is then pushed into the injector, using the ears 260 on the injector to facilitate operation with one hand, if desired. The stopper is held in a fixed position in the threaded end of the inner sleeve so that the closed end of the syringe barrel slides toward the stopper and forces liquid out of the barrel, through the cannulas, and into the container 42, where it mixes with the material there. The container normally has sufficient free space filled with sterile gas or air to permit all or most of the liquid to be expelled from the barrel, which is then released so the pressure created by the forcing of the liquid into the container to compress the gas now expels the mixture in the container back into the syringe barrel.

If necessary, the syringe barrel is reciprocated in the vial injector more than once to ensure complete solution or dispersion of the material in the container 42 in the liquid in the syringe barrel. Once mixing is complete, and the syringe barrel is full of the mixture, the system is now ready to be separated at the joint between the injector and the adapter to expose the Luer-lock nozzle, which can then be connected to a needleless system, or to a sterile hypodermic needle for immediate use.

The adapter and injector are separated by holding the adapter firmly in one hand and the injector firmly in the other, and twisting the injector in a direction to break the heat seals (if used) and decouple the Luer-lock connection, which is normally a right-handed thread. The vial injector and syringe barrel are now ready for use of the mixture in the normal way, and without ever exposing either of the cannulas used to achieve the mixing, which is quickly and easily effected through the cannulas, which can be of relatively large diameter because they will not be used to administer the mixture.

Moreover, after the adapter is unscrewed from the left end of the injector (so the injector can be connected either to a conventional hypodermic cannula with or without a protective device to prevent accidental sticking or to a "needleless" connection), the empty container and adapter remain locked in the assembled position, as shown in FIG. 4. The fingers engaging the annular shoulder prevent the adapter from being rocked from side to side, and thereby make it difficult to remove either accidentally or deliberately. The relatively small outside diameter and the short stubby dimension of the shroud 236 and first fitting on the outlet side of the adapter does not provide any substantial handle which could be used to try to pry the adapter off the container. For example, in one embodiment of the adapter, the outside diameter of the annular sidewall 220 is only about 25 mm, and the length of the fingers is only about 17 mm (as measured from their left (as viewed in FIGS. 1 and 3) ends to the end wall 212). The outside diameter of the shroud 236 is less than about 10 mm., and is less than about 10 mm long (as measured from the outlet side of the end wall 212 to the right (as viewed in FIGS. 4 and 6) end of the shroud. Thus, the spike or cannula formed integrally with the adapter and used in the initial mixing is kept protected from subsequent accidental contact.

Although four fingers are used for the preferred embodiment of this invention, a larger or smaller number, down to two, may be used, depending on the physical property of the material from which the fingers are made, and their relative dimensions. From the foregoing description, it is clear that the fingers should be flexible enough to deform relatively easily as the spike is driven through the container stopper, and yet have sufficient stiffness to drive the detents firmly into the locking position shown in FIG. 4—ideally, with a force sufficient to prevent the adapter from being removed without the aid of a tool.

Although the invention has been described above with respect to mixing and medications, other products can also be mixed in the apparatus. Such products include a resin adhesive, such as an epoxy resin, where a catalyst/activator constituent requires mixing with the resin just before use.

I claim:

1. Apparatus to facilitate mixing liquid with material stored in a container which includes a hollow body, a neck secured to and extending away from the body to provide an open mouth connected to the body interior, an outwardly extending annular lip around the mouth, the lip having an undersurface facing toward an outwardly extending annular shoulder on the body and spaced from the lip, the mouth being sealed by a resilient plug, the apparatus comprising:

an adapter including an end wall with a bore extending through it from an inlet side of the wall to an outlet side of the wall;

at least two separate elongated flexible fingers secured to the wall at spaced locations around the bore to define a cavity on the inlet side of the wall and opening away from the inlet side of the wall to receive the lip and neck of the container as the container is inserted into the cavity with the plug facing toward the wall, the diameter of the cavity being less than the maximum diameter of the container shoulder;

a fitting in the shape of socket having a passageway extending through it secured to the outlet side of the adapter wall so the fitting passageway is connected to the bore;

an elongated cannula secured at one end to the inlet side of the adapter wall around the bore so a passageway through the cannula is connected to the bore, the cannula extending away from the wall so the other end of the cannula will penetrate the plug in the container opening as the container is inserted into the cavity and thus provide a flow path from the material in the container to the passageway in the fitting; and inwardly facing detent means on each finger for making a snug fit against the undersurface of the lip, each finger being of sufficient length from the detent means in a direction away from the end wall to contact the annular shoulder on the container body when the detent means fit against the undersurface of the lip, each detent means includes a leading ramp that slopes inwardly toward the end wall to a peak, and a locking ramp which slopes outwardly from the peak and toward the end wall at a higher rate than that of the leading ramp.

2. Apparatus according to claim 1 in which the adapter end wall, fitting, and cannula are integrally molded from plastic.

3. Apparatus according to claim 2 in which the maximum exterior dimension of the fitting in a direction parallel to the bore through the adapter end wall is substantially less than the maximum exterior dimension of the adapter end wall perpendicular to the bore through the end wall.

4. Apparatus according to claim 1 in which the slope of the locking ramp is substantially less than 90° and is greater than that of the leading ramp.

* * * * *